US009646801B2

(12) United States Patent
Dalakos et al.

(10) Patent No.: US 9,646,801 B2
(45) Date of Patent: May 9, 2017

(54) MULTILAYER X-RAY SOURCE TARGET WITH HIGH THERMAL CONDUCTIVITY

(71) Applicant: General Electric Company, Schenectady, NY (US)

(72) Inventors: George Theodore Dalakos, Schenectady, NY (US); Mark Alan Frontera, Ballston Lake, NY (US); Vance Scott Robinson, Schenectady, NY (US); William Robert Ross, Rotterdam, NY (US); Xi Zhang, Ballston Lake, NY (US)

(73) Assignee: General Electric Company, Niskayuna, NY (US)

( * ) Notice: Subject to any disclaimer, the term of this patent is extended or adjusted under 35 U.S.C. 154(b) by 69 days.

(21) Appl. No.: 14/682,890

(22) Filed: Apr. 9, 2015

(65) Prior Publication Data

US 2016/0300686 A1 Oct. 13, 2016

(51) Int. Cl.
*H01J 35/12* (2006.01)
*H01J 35/10* (2006.01)

(52) U.S. Cl.
CPC ..... *H01J 35/12* (2013.01); *H01J 2235/088* (2013.01); *H01J 2235/1204* (2013.01); *H01J 2235/1233* (2013.01); *H01J 2235/1291* (2013.01)

(58) Field of Classification Search
CPC ..... H01J 35/08; H01J 2235/088
See application file for complete search history.

(56) References Cited

U.S. PATENT DOCUMENTS

| | | | | |
|---|---|---|---|---|
| 6,463,123 | B1 * | 10/2002 | Korenev | G21K 5/10 378/119 |
| 7,382,864 | B2 * | 6/2008 | Hebert | H01J 35/101 378/143 |
| 2005/0123097 | A1 * | 6/2005 | Wang | H01J 35/08 378/143 |
| 2007/0071174 | A1 * | 3/2007 | Hebert | H01J 35/101 378/144 |
| 2010/0040202 | A1 * | 2/2010 | Lee | H01J 35/08 378/143 |
| 2013/0195246 | A1 * | 8/2013 | Tamura | H01J 35/12 378/62 |
| 2014/0185778 | A1 * | 7/2014 | Lee | H01J 5/18 378/124 |

* cited by examiner

*Primary Examiner* — Wyatt Stoffa
*Assistant Examiner* — Eliza Osenbaugh-Stewar
(74) *Attorney, Agent, or Firm* — Jason K. Klindtworth

(57) ABSTRACT

In various embodiments, a multi-layer X-ray source target is provided having two or more layers of target material at different depths and different thicknesses. In one such embodiment the X-ray generating layers increase in thickness in relationship to their depth relative to the electron beam facing surface of the source target, such that X-ray generating layer further from this surface are thick than X-ray generating layers closer to the electron beam facing surface.

14 Claims, 11 Drawing Sheets

MULTILAYER X-RAY SOURCE TARGET WITH HIGH THERMAL CONDUCTIVITY

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A variety of medical diagnostic, laboratory, security screening, and industrial quality control imaging systems, along with certain other types of systems (e.g., radiation-based treatment systems), utilize X-ray tubes as a source of radiation during operation. Typically, the X-ray tube includes a cathode and an anode. An electron beam emitter within the cathode emits a stream of electrons toward an anode that includes a target that is impacted by the electrons.

A large portion of the energy deposited into the target by the electron beam produces heat within the target, with another portion of the energy resulting in the production of X-ray radiation. Indeed, only about 1% of the energy from the electron beam X-ray target interaction is responsible for X-ray generation, with the remaining 99% resulting in heating of the target. The X-ray flux is, therefore, highly dependent upon the amount of energy that can be deposited into the source target by the electron beam within a given period of time. However, the relatively large amount of heat produced during operation, if not mitigated, can damage the X-ray source (e.g., melt the target). Accordingly, conventional X-ray sources are typically cooled by either rotating or actively cooling the target. However, when rotation is the means of avoiding overheating, the amount of deposited heat is limited by the rotation speed (RPM), target heat storage, radiation and conduction, and the life of the supporting bearings, this limits the amount of deposited heat and X-ray flux. This also increases the overall volume, and weight of the X-ray source systems. When the target is actively cooled, such cooling generally occurs far from the electron beam impact area, which in turn significantly limits the electron beam power that can be applied to the target. In both situations, the restricted heat removal ability of the cooling methods markedly lowers the overall flux of X-rays that are generated by the X-ray tube.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible embodiments. Indeed, the invention may encompass a variety of forms that may be similar to or different from the embodiments set forth below.

In a first embodiment, an X-ray source is provided. The X-ray source includes an emitter configured to emit an electron beam and a target having an emitter-facing surface and configured to generate X-rays when impacted by the electron beam. The target includes: two or more X-ray generating layers at different depths relative to the emitter-facing surface, each X-ray generating layer having a different thickness; and at least one intervening thermally-conductive layer between each pair of X-ray generating layers.

In a second embodiment, a method for fabricating an X-ray source target is provided. In accordance with this method, a first X-ray generating layer is formed. The first X-ray generating layer has a first thickness. On the first X-ray generating layer, one or more sets are formed of: an intervening thermally-conductive layer; and an additional X-ray generating layer. Each X-ray generating layer has a different thickness than other X-ray generating layers.

In a third embodiment, an X-ray source target is provided. The X-ray source target includes two or more X-ray generating layers, each comprising an X-ray generating material, and each X-ray generating layer having a different thickness.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
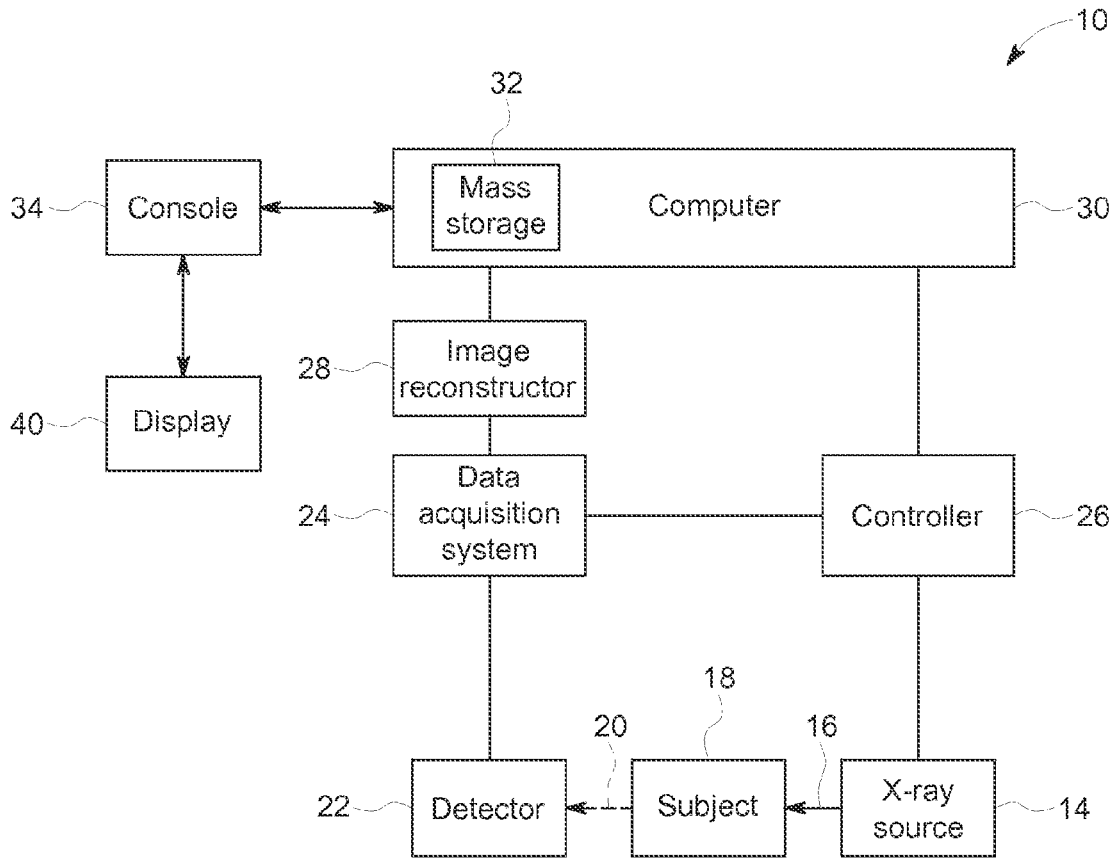
FIG. 1 is a block diagram of an X-ray imaging system, in accordance with aspects of the present disclosure.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

As noted above, the X-ray flux produced by an X-ray source may depend on the energy and intensity of an electron beam incident on the source's target region. The energy deposited into the target produces, in addition to the X-ray flux, a large amount of heat. Accordingly, during the normal course of operation, a source target is capable of reaching temperatures that, if not tempered, can damage the target. The temperature rise, to some extent, can be managed by convectively cooling, also referred to as "direct cooling", the target. However, such cooling is macroscopic and does not occur immediately adjacent to the electron beam impact area where damage i.e. melting, can occur. Without microscopic localized cooling, the overall flux of X-rays produced by the source is limited, potentially making the source unsuitable for certain applications, such as those requiring high X-ray flux densities. Rotating the target such that the electron beam distributes the energy over a larger area can reduce the target temperature locally but it typically requires larger evacuated volumes and the additional complexity of rotating components such as bearings. Further, vibrations associated with rotating targets become prohibitive for high resolution applications where the required feature detectability is on the order of ten's of microns and may be on the same order as the amplitude of the vibration. Accordingly, it would be desirable if the source could be operated in a substantially continuous basis in a manner that enables the output of high X-ray flux.

The present disclosure provides embodiments of systems including an X-ray source having features configured to reduce thermal buildup in the X-ray source. For example, certain of the embodiments discussed herein include a multi-layer source target (e.g., anode) having two or more X-ray generation layers and having thermally conductive material disposed in thermal communication with the X-ray generation layers. As used herein, an X-ray generating layer may include a layer or film of X-ray generating material extending in a continuous (i.e., uninterrupted or unbroken) manner across the X-ray generating layer. In other embodiments, an X-ray generating layer may be formed as a discontinuous (i.e., broken or interrupted) layer or film of X-ray generating material within such an X-ray generating layer. Thus, an X-ray generating region as used herein, may reference either a continuous sheet of X-ray generating material or all or part of a discontinuous sheet within an X-ray generating layer.

The thermally conductive layers that are in thermal communication with the X-ray generating layers generally have a higher overall thermal conductivity than the X-ray generating material. The one or more thermally conductive layers may be disposed in numerous locations within the source target, including (but not limited to) between the electron beam emitter (i.e., cathode) and the topmost X-ray generating layer (i.e., as a surface heat-conduction layer), between two of the X-ray generating layers, and/or beneath the bottommost X-ray generating layer (i.e., as an underlying or substrate layer). The one or more thermally conductive layers may generally be referred to as "heat-dissipating" or "heat-spreading" layers, as they are generally configured to dissipate or spread heat away from the X-ray generating materials impinged on by the electron beam to enable enhanced cooling efficiency. Having better heat conduction within the source target (e.g., anode) allows the end user to operate the X-ray target at higher powers or smaller spot sizes while maintaining the source target at the same target operational temperatures. Alternatively, the source target can be maintained at lower temperatures at the same X-ray source power levels, thus increasing the operational lifetime of the source target. The former option translates into higher throughput as higher X-ray source power results in quicker measurement exposure times or improved feature detectability as smaller spot sizes results in smaller features being distinguishable. The latter option results in lower operational (variable) expenses for the end user as targets or tubes (in the case where the target is an integral part of the tube) will be replaced at a lower frequency.

The present disclosure describes a variety of configurations of a multi-layer source target having multiple X-ray generating layers and multiple thermally conductive layers. In certain of these configurations, the thicknesses of at least some of the X-ray generating layers (and/or thermal conduction layers) are different, such as in embodiments where the X-ray generating layers are constructed to be thicker the further an X-ray generating layer is from the surface impacted by the electron beam (i.e., the deeper the X-ray generating layer in the source target, the thicker the X-ray generating layer). Depending on the respective embodiment, a given X-ray generating layer may fully extend across a given layer or may extend over only a limited portion of the respective layer. That is the X-ray generating regions within an X-ray generating layer may be formed as plugs, rings, or other limited extent structures relative to an overall cross-section of the layer.

X-ray sources as discussed herein may be based on a stationary (i.e., non-rotating) anode structure or a rotating anode structure and may be configured for either reflective or transmissive X-ray generation. As may be appreciated, power entitlement for a given X-ray generating structure may vary based on kV and focal spot size, as discussed herein. As used herein, a transmission-type arrangement is one in which the X-ray beam is emitted from a surface of the target opposite the surface that is subjected to the electron beam. Conversely, in a reflection arrangement, the angle at which X-rays leave the target is typically acutely angled relative to the perpendicular to the target. This effectively increases the X-ray density in the output beam, while allowing a much larger thermal spot on the target, thereby decreasing the thermal loading of the target.

By way of an initial example, in one implementation, an electron beam passes through the relatively transparent thermally conductive layer (e.g., a diamond layer) and is preferentially absorbed by two or more X-ray generating (e.g., tungsten) layers or regions. The thickness of the X-ray generating layers, as discussed herein, may be related to the depth of the respective layer within the source target (i.e., anode structure). After being absorbed in the X-ray generating regions, X-ray photons and heat are produced. The majority of the absorbed energy is translated into heat. The surrounding thermally-conductive material carries away the heat much more effectively than X-ray generating material.

This reduces the concentration of heat within the multi-layered structure. Since the maximum temperature within the X-ray generating material is reduced, the power of the electron beam (and the corresponding X-ray generation) can be increased or the spot size can be reduced versus a conventional design without melting the X-ray generating region. The increase in power results in faster sample inspection or longer life. The reduction in spot size results in smaller feature detectability.

With the preceding in mind, and referring to FIG. 1, an X-ray imaging system 10 is shown as including an X-ray source 14 that projects a beam of X-rays 16 through a subject 18 (e.g., a patient or an item undergoing security or quality control inspection). It should be noted that while the imaging system 10 may be discussed in certain contexts, the X-ray imaging systems disclosed herein may be used in conjunction with any suitable type of imaging context or any other X-ray implementation. For example, the system 10 may be part of a fluoroscopy system, a mammography system, an angiography system, a standard radiographic imaging system, a tomosynthesis or C-arm system, a computed tomography system, and/or a radiation therapy treatment system. Further, the system 10 may not only be applicable to medical imaging contexts, but also to various inspection systems for industrial or manufacturing quality control, luggage and/or package inspection, and so on. Accordingly, the subject 18 may be a laboratory sample, (e.g., tissue from a biopsy), a patient, luggage, cargo, manufactured parts, nuclear fuel, or other material of interest.

The subject may, for example, attenuate or refract the incident X rays 16 and produce the projected X-ray radiation 20 that impacts a detector 22, which is coupled to a data acquisition system 24. It should be noted that the detector 22, while depicted as a single unit, may include one or more detecting units operating independently or in conjunction with one another. The detector 22 senses the projected X-rays 20 that pass through or off of the subject 18, and generates data representative of the radiation 20. The data acquisition system 24, depending on the nature of the data generated at the detector 22, converts the data to digital signals for subsequent processing. Depending on the application, each detector 22 produces an electrical signal that may represent the intensity and/or phase of each projected X-ray beam 20.

An X-ray controller 26 may govern the operation of the X-ray source 14 and/or the data acquisition system 24. The controller 26 may provide power and timing signals to the X-ray source 14 to control the flux of the X-ray radiation 16, and to control or coordinate with the operation of other system features, such as cooling systems for the X-ray source, image analysis hardware, and so on. In embodiments where the system 10 is an imaging system, an image reconstructor 28 (e.g., hardware configured for reconstruction) may receive sampled and digitized X-ray data from the data acquisition system 24 and perform high-speed reconstruction to generate one or more images representative of different attenuation, differential refraction, or a combination thereof, of the subject 18. The images are applied as an input to a processor-based computer 30 that stores the image in a mass storage device 32.

The computer 30 also receives commands and scanning parameters from an operator via a console 34 that has some form of operator interface, such as a keyboard, mouse, voice activated controller, or any other suitable input apparatus. An associated display 40 allows the operator to observe images and other data from the computer 30. The computer 30 uses the operator-supplied commands and parameters to provide control signals and information to the data acquisition system 24 and the X-ray controller 26.

Figure 2:
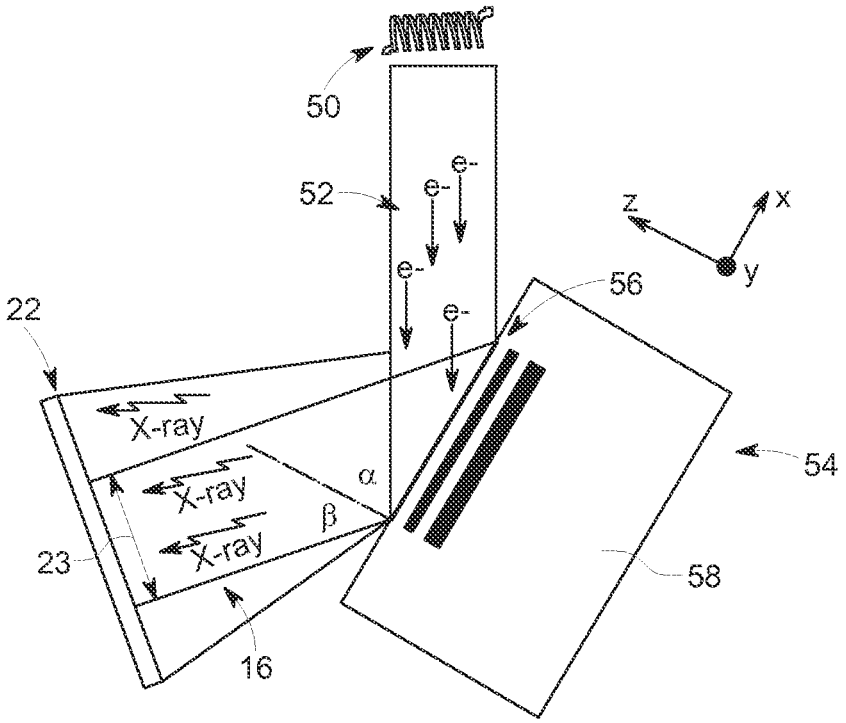
FIG. 2 depicts a generalized view of a multi-layer X-ray source and detector arrangement, in accordance with aspects of the present disclosure.

Referring now to FIG. 2, a high level view of components of an X-ray source 14, along with detector 22, are depicted. The aspects of X-ray generation shown are consistent with a reflective X-ray generation arrangement that may be consistent with either a rotating or stationary anode. In the depicted implementation, an X-ray source includes an electron beam emitter (here depicted as an emitter coil 50) that emits an electron beam 52 toward a target region of X-ray generating material 56. The X-ray generating material may be a high-Z material, such as tungsten, molybdenum, titanium-zirconium-molybdenum alloy (TZM), tungsten-rhenium alloy, or any other material or combinations of materials capable of emitting X-rays when bombarded with electrons). The source target may also include one or more thermally-conductive materials, such as substrate 58, or thermally conductive layers or other regions surrounding the X-ray generating material 56. As used herein, a region of X-ray generating material 56 is generally described as being an X-ray generating layer or being a portion of an X-ray generating layer of the source target, where the X-ray generating layer has some corresponding thickness, which may vary for different X-ray generating layers within a given source target.

The electron beam 52 incident on the X-ray generating material 56 generates X-rays 16 that are directed toward the detector 22 and which are incident on the detector 22, the optical spot 23 being the area of the focal spot projected onto the detector plane. The electron impact area on the X-ray generating material 56 may define a particular shape, thickness, or aspect ratio on the source target (i.e., anode 54) to achieve particular characteristics of the emitted X-rays 16. For example, the emitted X-ray beam 16 may have a particular size and shape that is related to the size and shape of the electron beam 52 when incident on the X-ray generating material 56. Accordingly, the X-ray beam 16 exits the source target 54 from an X-ray emission area that may be predicted based on the size and shape of the impact area. In the depicted example the angle between the electron beam 52 and the normal to the target is defined as $\alpha$. The angle $\beta$ is the angle between the normal of the detector and the normal to the target. Where b is the thermal focal spot size at the target region 56 and c is optical focal spot size, $b=c/\cos\beta$. Further, in this arrangement, the equivalent target angle is $90-\beta$.

As discussed herein, various embodiments, employ a multi-layer source target 54 having two or more X-ray generating layers in the z-dimension (i.e., two or more layers incorporating the X-ray generating material) separated by respective thermally conductive layers (including top layers and/or substrates 58). Such a multi-layer source target 54 (including the respective layers and/or intra-layer structures and features discussed herein) may be fabricated using any suitable technique, such as suitable semiconductor manufacturing techniques including vapor deposition (such as chemical vapor deposition (CVD)), sputtering, atomic layer deposition, chemical plating, ion implantation, or additive or reductive manufacturing, and so on.

Referring to FIG. 2, generally the thermally conductive layers (generally defined in the x,y plane and having depth or elevation in the z-dimension shown) are configured to conduct heat away from the X-ray generating material during operation. That is, the thermal materials discussed herein have thermal conductivities that are higher than those exhibited by the X-ray generating material. By way of non-limiting example, a thermal-conducting layer may include carbon-based materials including but not limited to highly ordered pyrolytic graphite (HOPG), diamond, and/or metal-based materials such as beryllium oxide, silicon carbide, copper-molybdenum, oxygen-free high thermal conductivity copper (OFHC), or any combination thereof. Alloyed materials such as silver-diamond may also be used. Table 1 below provides the composition, thermal conductivity, coefficient of thermal expansion (CTE), density, and melting point of several such materials.

TABLE 1

| Material | Composition | Thermal Conductivity W/m-K | CTE ppm/K | Density g/cm$^3$ | Melting point ° C. |
|---|---|---|---|---|---|
| Diamond | Polycrystal-line diamond | 1200 | 1.5 | 3.5 | 3550 |
| Beryllium oxide | BeO | 250 | 7.5 | 2.9 | 2578 |
| CVD SiC | SiC | 250 | 2.4 | 3.2 | 2830 |
| Highly oriented pyrolytic graphite | C | 1700 | 0.5 | 2.25 | NA |
| Cu—Mo | Cu—Mo | 400 | 7 | 9-10 | 1100 |
| Ag-Diamond | Ag-Diamond | 650 | <6 | 6-6.2 | 961-3550 |
| OFHC | Cu | 390 | 17 | 8.9 | 1350 |

It should be noted that the different thermally-conductive layers, structures, or regions within a source target 54 may have correspondingly different thermally-conductive compositions, different thicknesses, and/or may be fabricated differently from one another, depending on the respective thermal conduction needs at a given region within the source target 54. However, even when differently composed, such regions, if formed so as to conduct heat from the X-ray generating materials, still constitute thermally-conductive layers (or regions) as used herein.

In certain embodiments, the X-ray generating material(s) 56 may be provided over a limited extent relative to the effective source target 54 surface area (in a given x,y, plane), e.g., as a discrete "plug" or a "ring" within the larger target mass or area corresponding to a cross-section in an x,y plane. In particular, studies performed in support of the present document have shown that limiting the active X-ray producing (but low thermal conductivity material) region(s) (i.e., X-ray generating materials 56) to the size of the electron beam 52 (i.e., a plug) can allow an increase in the maximum power. In such an arrangement, heat transfer may be facilitated away from the region-ray generating material 56 by thermally-conductive materials not only above and below the X-ray generating layers, but also within the X-ray generating layers, such as disposed laterally with respect to the X-ray generating materials 56 within a layer.

Further, as discussed herein, in various embodiments respective depth (in the z-dimension) within the source target 54 may determine the thickness of a region X-ray generating region or layer found at that depth, such as to accommodate the electron beam incident energy expected at that depth. That is, X-ray generating layers or regions at different depths within a source target 54 may be formed so as to have different thicknesses. Similarly, depending on heat conduction requirements at a given depth, the differing thermal-conductive layers may also vary in thickness, either based upon their depth in the source target 54 or for other reasons related to optimizing heat flow and conduction.

Figure 3:
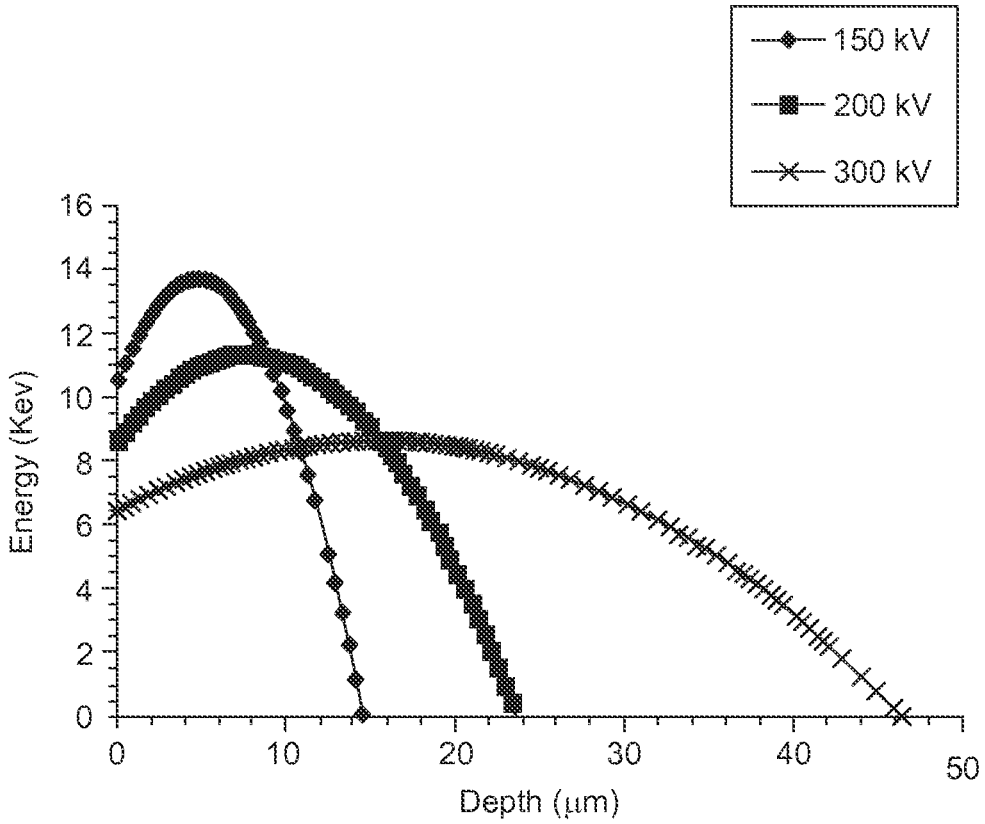
FIG. 3 graphically depicts electron beam power deposition as a function of depth, in accordance with aspects of the present disclosure.

To further develop this concept, FIG. 3 graphically depicts electron beam power deposition in the X-ray generating material 56 (e.g., tungsten) as a function of depth (as measured in the z-dimension) within the source target 54 and the voltage used to generate the electron beam 52. As evidenced graphically in FIG. 3, the deposition of power from the electron beam 52 is a function of both the generating voltage and the depth within the source target 54. That is, deposition is maximized at different depths within the source target 54 (i.e., anode) dependent on the generating voltage or, alternatively, the generating voltage determines at what depth within the source target 54 the electron beam energy will be primarily deposited. In particular, a "low" energy electron beam (e.g., a 150 kV beam) penetrates less deeply into the source target 54, primarily depositing its energy in the top 14 μm of the source target 54 (e.g., between 0 μm and 15 μm depth) and primarily at approximately 5 μm deep within the source target 54. Conversely, a "high" energy electron beam (e.g., a 300 kV beam) penetrates deeper into the source target 54, depositing its energy in the top 46 μm of the source target 54 (e.g., between 0 μm and 50 μm depth) and primarily at approximately 18 μm deep within the source target 54. Between these example, a 200 kV beam (e.g., an intermediate energy beam) deposits its energy in the top 24 μm of the source target 54 (e.g., between 0 μm and 25 μm depth) and primarily at approximately 9 μm deep within the source target 54.

As will be appreciated, it is this electron beam energy which is used to generate X-rays (preferably) within the X-ray generating materials 56 within the source target 54 and which, secondarily, generates heat. Further, the electron beam may be operated at different voltages so as to generate different X-ray energy spectra (e.g., high or low energy X-ray spectra). Hence, at different operating energies, it is desirable to have the bulk of the electron beam energy deposited into the portions of the source target 54 capable of generating X-rays and to minimize or reduce the amount of electron beam energy that is deposited in non-X-ray generating materials (e.g., heat-conduction material or layers).

These considerations are not typically a concern for source targets having a single layer or region of X-ray generating material as this material can be provided with sufficient thickness to absorb all or substantially all of the electron beam energy. However, in embodiments of an X-ray source target 54 where the X-ray generating material 56 is provided in discrete and different layers in the z-dimension, it may be desirable to take these considerations into account when determining the depth and thickness of the X-ray generating materials 56 and to provide a source target 54 capable of operating optimally at different electron beam voltages. By way of example, and as discussed with respect to certain embodiments, herein, X-ray generating layers (e.g., tungsten layers) are provided in different thicknesses within a stacked configuration, such as having increasing thickness as depth within the stack increases. By varying thickness of the X-ray generating layers in this manner (i.e., along the electron beam deposition direction) the electron beam power deposition may be improved (e.g., optimized) within the X-ray generating structure. For example, in one example, the thickness of the top tungsten layer in the stack was reduced from 10 μm to 8 μm, allowing more power to reach the next (i.e., second) layer of tungsten in the stack. In this manner, the temperature at top tungsten-diamond interface may be reduced. In one such example the topmost tungsten layer may be 8 μm, the middle tungsten layer may be 10 μm, and the bottom tungsten layer (i.e., the layer furthest from the electron beam emitter) may be 12 μm.

Figure 4:
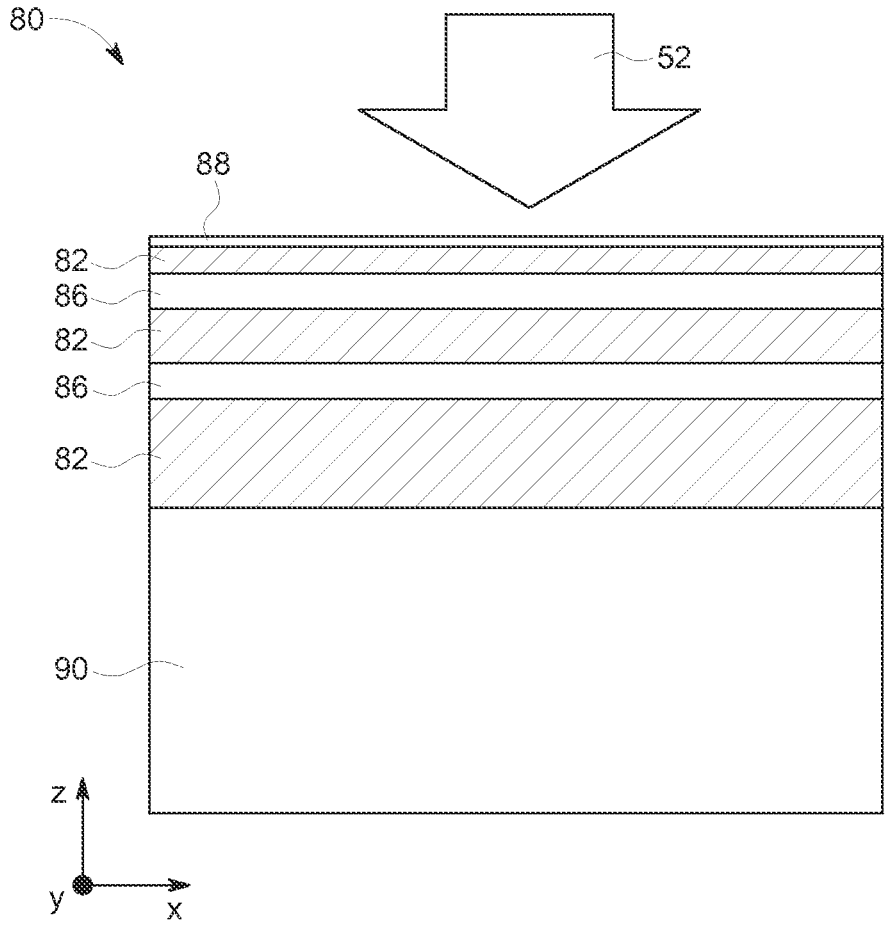
FIG. 4 depicts a first embodiment of a multi-layer source target, in accordance with aspects of the present disclosure.
Figure 5:
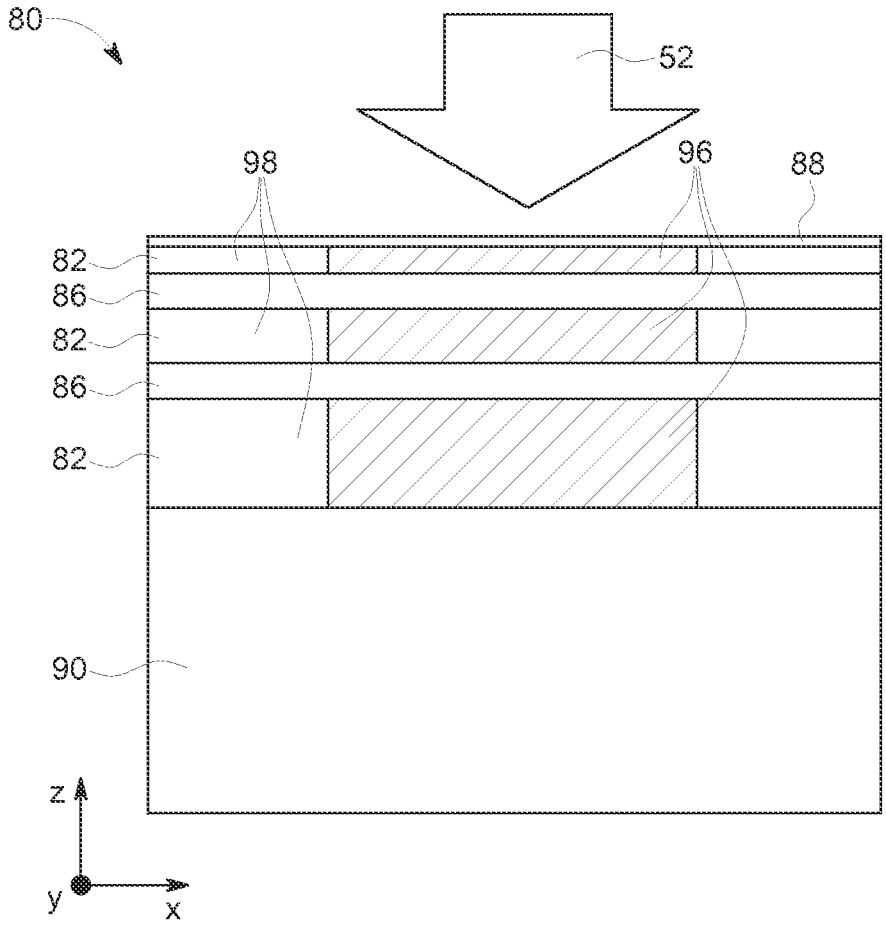
FIG. 5 depicts a second embodiment of a multi-layer source target, in accordance with aspects of the present disclosure.

With this in mind, FIGS. 4 and 5 depict examples of different reflection-type, stationary source target arrangements incorporating these concepts. By way of example, FIG. 4 depicts a multi-layer source target 80 having multiple distinct X-ray generating layers 82, each comprised of an X-ray generating material 56 (e.g., tungsten). In the depicted example, the X-ray generating layers 82 are continuous relative to the source target 80 in that each layer 82 extends the length and width of the source target 80 within a given layer or cross-section.

In this example, the X-ray generating layers 82 are separated by thermally-conductive layers 86 which may be composed of a suitable material (e.g., diamond) exhibiting higher thermal conductivity than the X-ray generating material. In addition, the depicted arrangement also shows a thermally-conductive bottom substrate 88 and a thermally conductive top layer 90 with respect to the z-dimension shown. Both the substrate 88 and top layer 90 may be composed of a material (e.g., diamond) exhibiting higher thermal conductivity than the X-ray generating material.

Though certain implementations may be constructed using the same X-ray generating material for each X-ray generating layer 82 and/or the same thermally-conductive material for each of the thermally-conductive layer 96, the top layer 88 and the substrate 90, this need not be the case. For example different X-ray generating materials and/or thermally conductive materials may be employed within different regions of the source target 80, depending on design and/or fabrication consideration. In addition, the transitions between different layers of the source target 80 need not be sharp, but may instead be graded, such that the transition from one layer to another is achieved in a gradual manner as opposed to abruptly. Further, the number and/or order of layers within the source target may be other than what is shown in the present example (as discussed in greater detail herein) For example, a layer of X-ray generating material may form the bottommost layer (in the z-dimension) instead of a substrate 90 of thermally conductive material. Similarly, no thermally conductive top-layer 88 may be present, with a layer of X-ray generating material instead forming the uppermost layer (in the z-dimension).

In the depicted example, in accordance with the preceding discussion, the layers of X-ray generating material 82 at different depths (in the z-dimension) within the source target 80 have correspondingly different thicknesses. In this example, X-ray generating layers 82 at deeper depths within the source target 80 have correspondingly greater thickness such that power from the electron beam 52 capable of penetrating to those greater depths is more likely to be absorbed by a layer of X-ray generating material instead of the thermally conductive material. This may be desirable for a variety of reasons. For example, electron beam energy absorbed by a layer 82 of X-ray generating material may be used to generate X-rays, which is the function of the source target 80.

In addition, depending on the composition of the respective layers, the thermal limits of the different materials may differ and it may be desirable for the bulk of the electron beam energy to be deposited in those materials having a higher thermal limit. By way of example, the thermal limit for tungsten is 2,500° C. and the thermal limit for diamond is 1,500° C. Therefore, in an implementation in which the X-ray generating material is tungsten and the thermally-conductive material is diamond, it may be desirable to optimize the thickness of the tungsten layers based on the power deposition of the electron beam so as to protect the thermally conductive diamond layers. Such an arrangement is shown in FIG. 4, in which the deeper X-ray generating layers 82 are thicker so as to better capture the broader and deeper energy deposition spread of a high energy electron beam (e.g., the 300 kV beam of FIG. 3). Conversely, the shallower X-ray generating layers 82 are less thick so as to optimally capture the narrower and shallower energy deposition spread of a low energy electron beam (e.g., the 150 kV beam of FIG. 3). In between X-ray generating layers 82, correspondingly may be of intermediate thickness so as to correspond to electron beam energies between these high and low levels.

Turning to FIG. 5, a similar multiple X-ray generating layer arrangement is shown with the difference being that the X-ray generating layers 82 are formed over a limited extent (i.e., X-ray generating regions 96) within the layer, with the remainder of the X-ray generating layer 82 being formed from non-X-ray generating materials 98, such as thermally-conductive materials. By way of example the X-ray generating region 96 within an X-ray generating layer 82 may be provided as a plug, ring or other constrained geometry within the X-ray generating layer 82 such that the cross-section of the X-ray generating region 96 (in an x, y plane) is less than the cross-section of the corresponding X-ray generating layer 82, with the remainder of the X-ray generating layer 82 potentially being thermally conductive to help remove heat from the X-ray generating region 96 during operation. By way of example, in such an embodiment, the cross-section (or other size metric) of a given X-ray generating region 96 may correspond to the incidence of the electron beam 52 on the respective X-ray generating layer 82 so as to better optimize the conversion of the electron beam 52 to X-ray energy and/or to improve the cooling of the X-ray generating material during operation. That is, the size of the X-ray generating region 96 within an X-ray generating layer 82 may correspond to the extent of the respective X-ray generating layer 82 impacted by the electron beam 52.

With the preceding discussion in mind, Table 2 sets forth a variety of multi-layer source target configurations for a stationary, reflection-type target. Table 3 sets forth target power and power ratio values for the target configurations set forth in Table 2 using a 240 kV electron beam.

TABLE 2

| Substrate (1.2 mm) | Name | 1st Layer | 2nd Layer | 3rd Layer | 4th Layer | 5th Layer | 6th Layer |
|---|---|---|---|---|---|---|---|
| W | W3 | 10 μD | 13 μW | 4 μD | | | |
| | W5 | 10 μD | 18 μW | 10 μD | 12 μW | 4 μD | |
| D | D2 | 30 μW | 4 μD | | | | |
| | D4 | 18 μW | 10 μD | 12 μW | 4 μD | | |
| | D6 | 12 μW | 10 μD | 10 μW | 10 μD | 8 μW | 4 μD |

In Tables 2 and 3, W denotes tungsten, D denotes diamond. In Table 2, layers are counted upward from the substrate (i.e., base or bottom) layer, and the substrate in the first two rows is 1.2 mm of tungsten and in the bottom three rows is 1.2 mm if diamond. The name denotes the substrate material and the number of rows formed on the substrate.

TABLE 3

| | Target Power Ratio | |
|---|---|---|
| Case | 25 μm | 50 μm |
| W (baseline) | 1 | 1 |
| W3 | 2 | 1.5 |
| W5 | 2.1 | 1.7 |
| D2 | 1.8 | 1.8 |
| D4 | 2.64 | 2.5 |
| D6 | 3.9 | 3.3 |

Table 3 shows an additional entry for a single-layer tungsten target, denoted "W (baseline) for comparison and shows estimates for two different optical focal spot diameters, 25 μm and 50 μm. As shown in table 3, at 240 kV, estimated power ratio improvements range from 1.8× to 3.9× for a 25 μm optical focal spot to 1.5× to 3.3× for a 50 μm optical focal spot.

Figure 6:
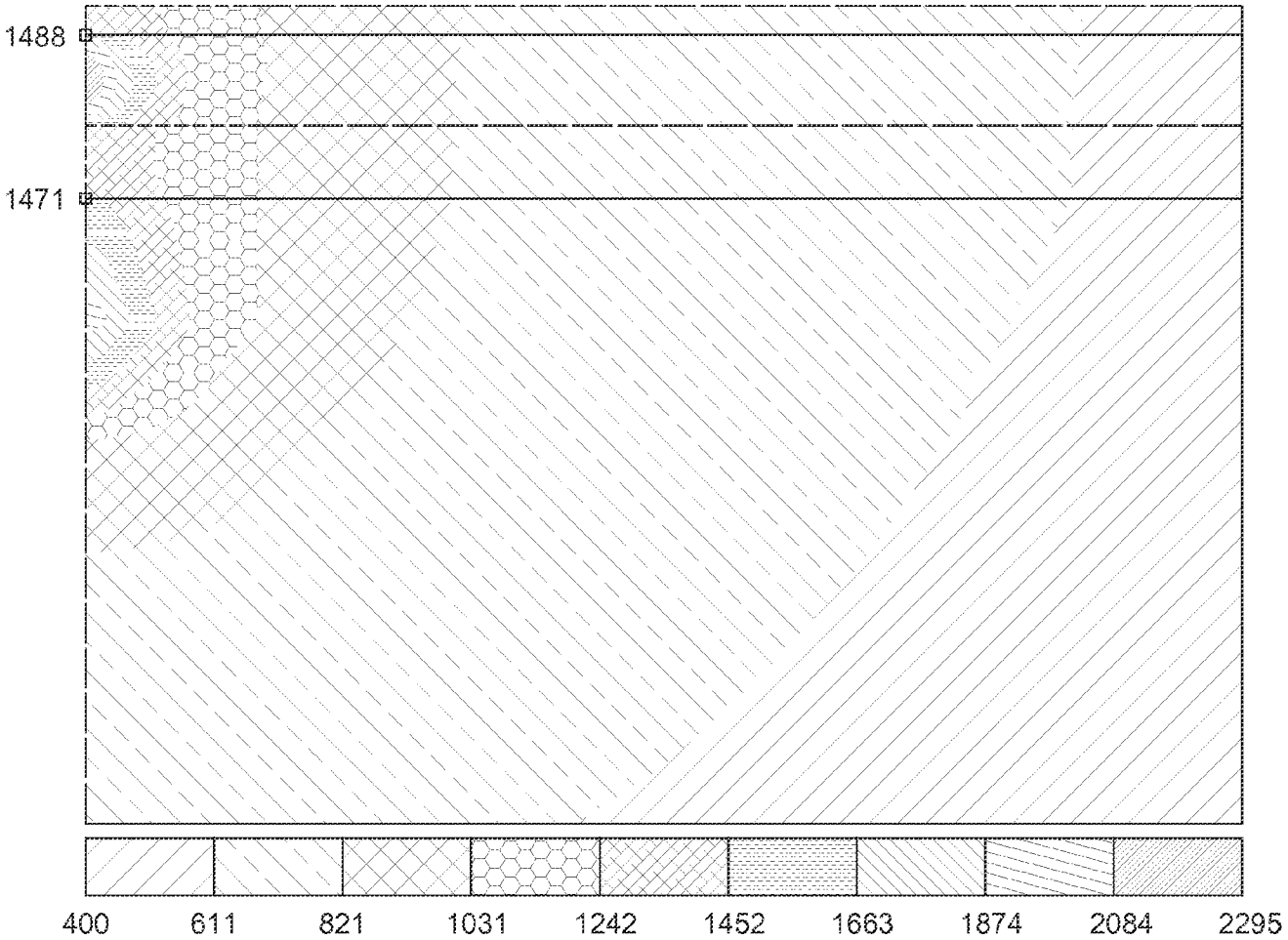
FIG. 6 graphically depicts a thermal profile of a first embodiment of a multi-layer source target, in accordance with aspects of the present disclosure.
Figure 7:
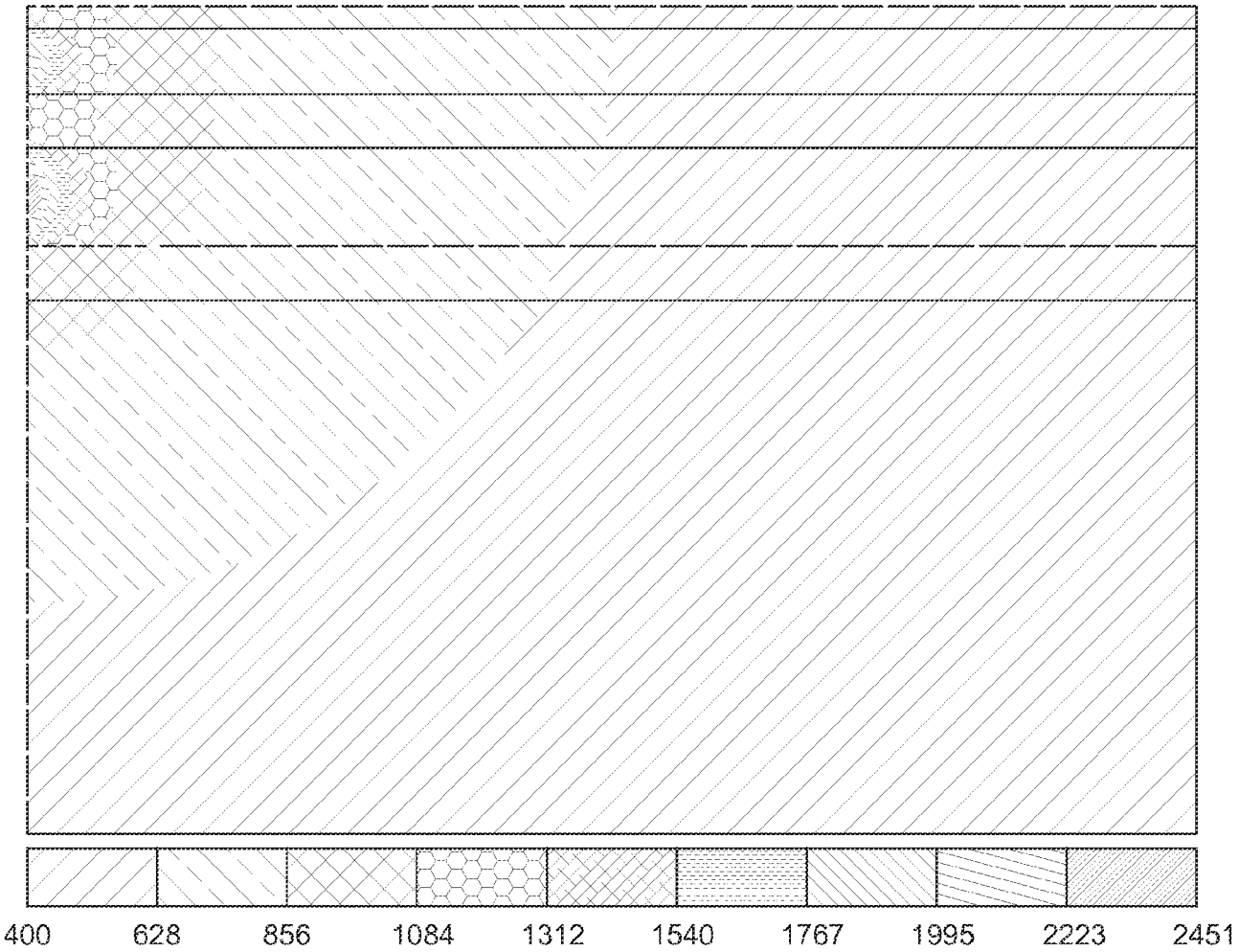
FIG. 7 graphically depicts a thermal profile of a second embodiment of a multi-layer source target, in accordance with aspects of the present disclosure.
Figure 8:
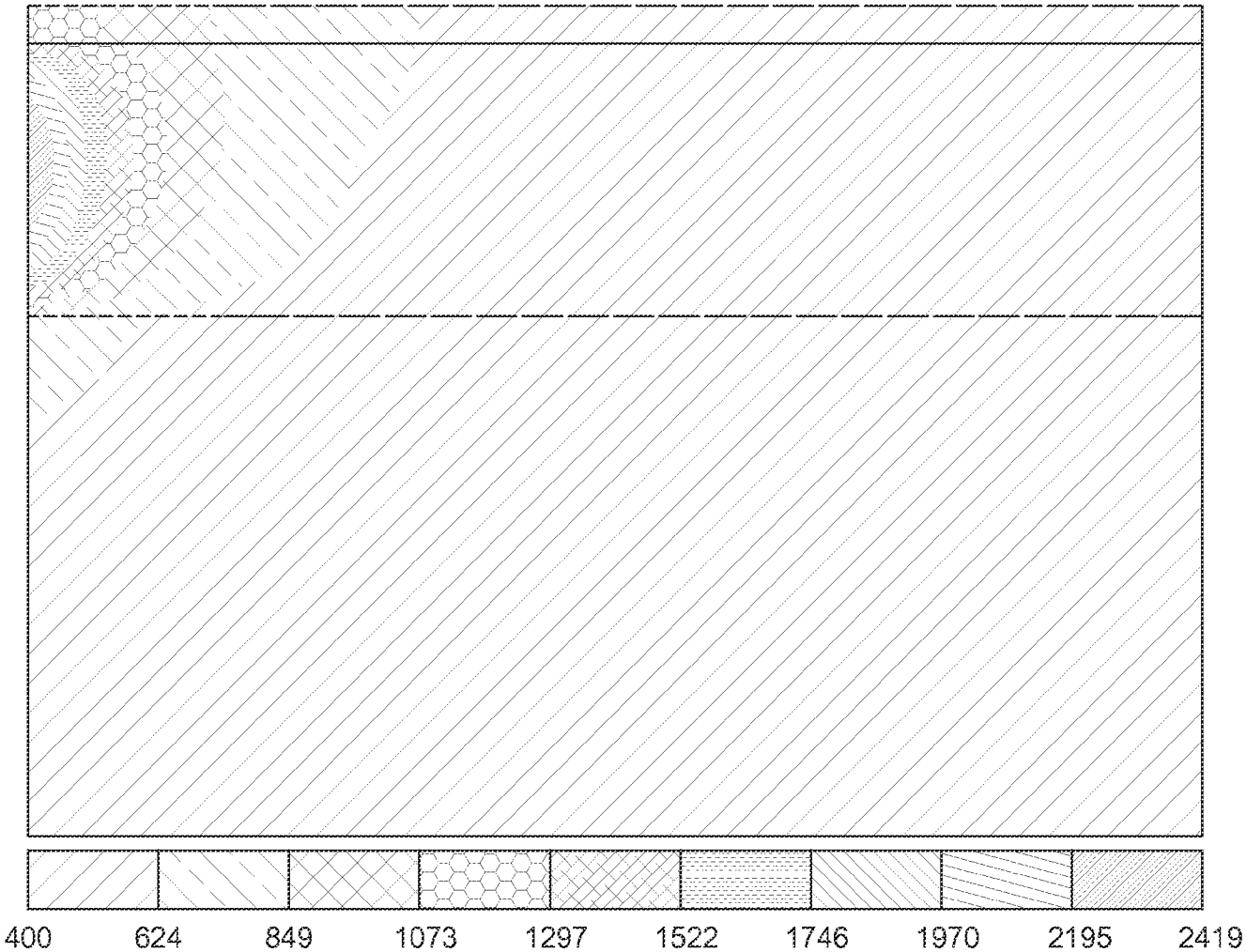
FIG. 8 graphically depicts a thermal profile of a third embodiment of a multi-layer source target, in accordance with aspects of the present disclosure.
Figure 9:
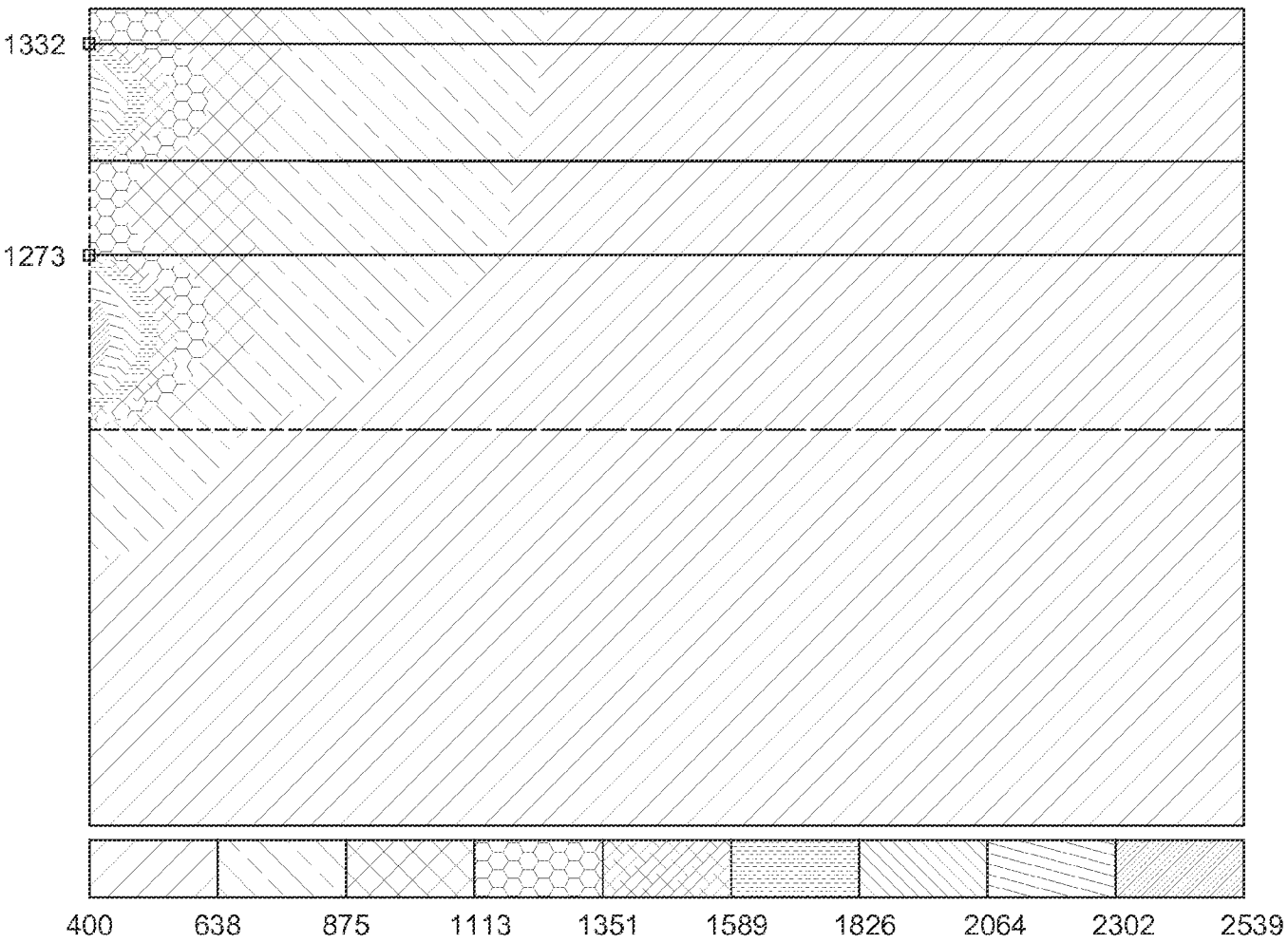
FIG. 9 graphically depicts a thermal profile of a fourth embodiment of a multi-layer source target, in accordance with aspects of the present disclosure.
Figure 10:
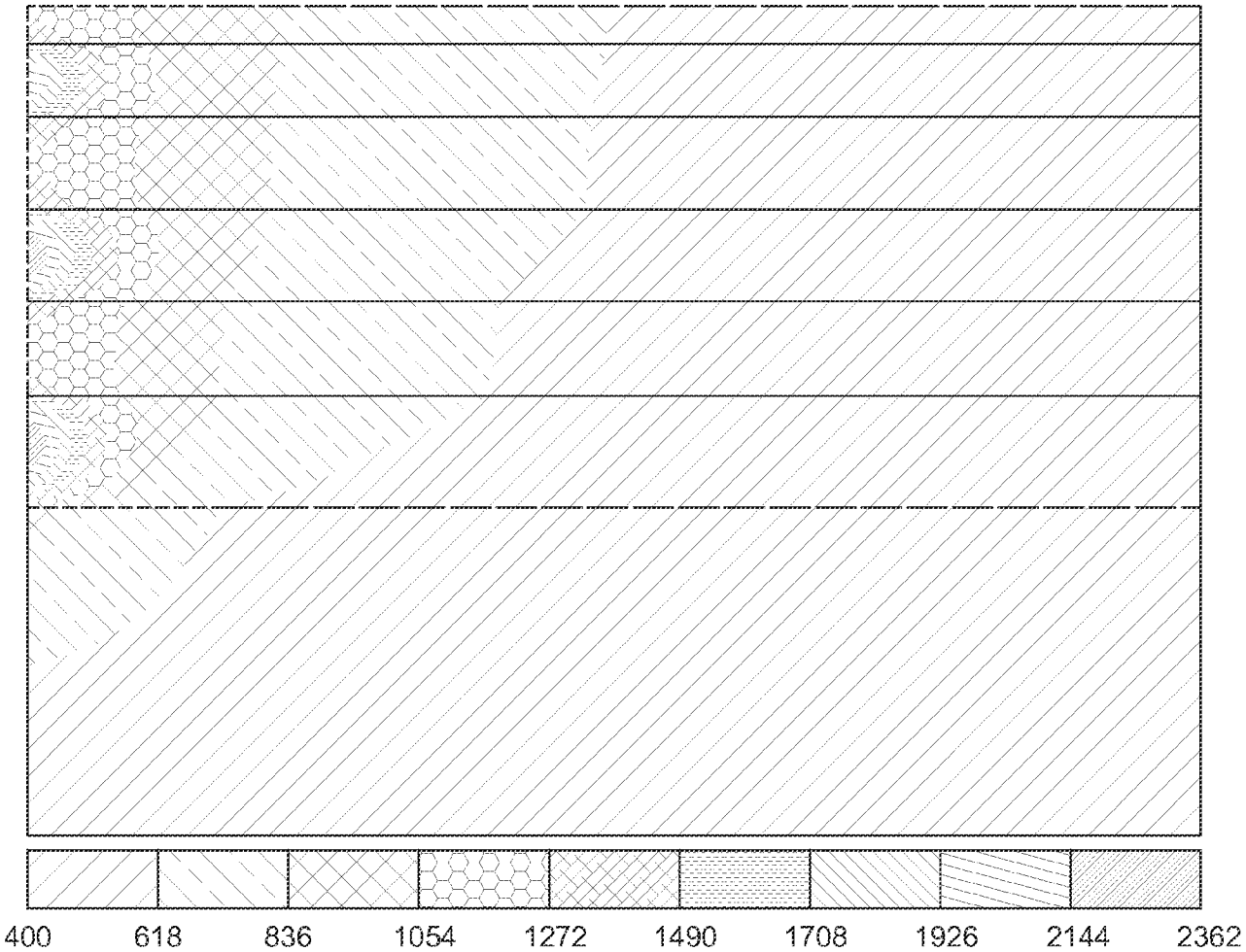
FIG. 10 graphically depicts a thermal profile of a fifth embodiment of a multi-layer source target, in accordance with aspects of the present disclosure.

Thermal results are graphically depicted in FIGS. 6-10, which graphically depict expected temperatures at different layers of a multi-layer source target under the 25 μm optical focal spot and 240 kV electron beam scenario for targets W3 (FIG. 6), W5 (FIG. 7), D2 (FIG. 8), D4 (FIG. 9), and D6 (FIG. 10). As can be seen in FIG. 6 showing the W3 results, heat is localized to the 13 μm tungsten layer and the 1.2 mm tungsten substrate, with temperatures in the diamond top layer and intervening layer staying below the thermal limit of 1,500° C. for diamond. Similarly, in FIG. 7, showing the W5 results, heat is localized to the 12 μm and 18 μm tungsten layers and the 1.2 mm tungsten substrate. With respect to the diamond substrate embodiments, turning to FIGS. 8-10, FIG. 8 depicts the D2 results, with heat being localized to the 30 μm tungsten layer. FIG. 9 depicts the D4 results, with heat being localized to the 12 μm and 18 μm tungsten layers. FIG. 10 depicts the D6 results, with heat being localized to the 8 μm, 12 μm, and 18 μm tungsten layers. As these respective demonstrations show, the electron beam energy is absorbed in the tungsten layers of different thickness (corresponding to depth within the source target), helping protect the intervening diamond layers by keeping temperature of the diamond layers below the thermal limit.

Figure 11:
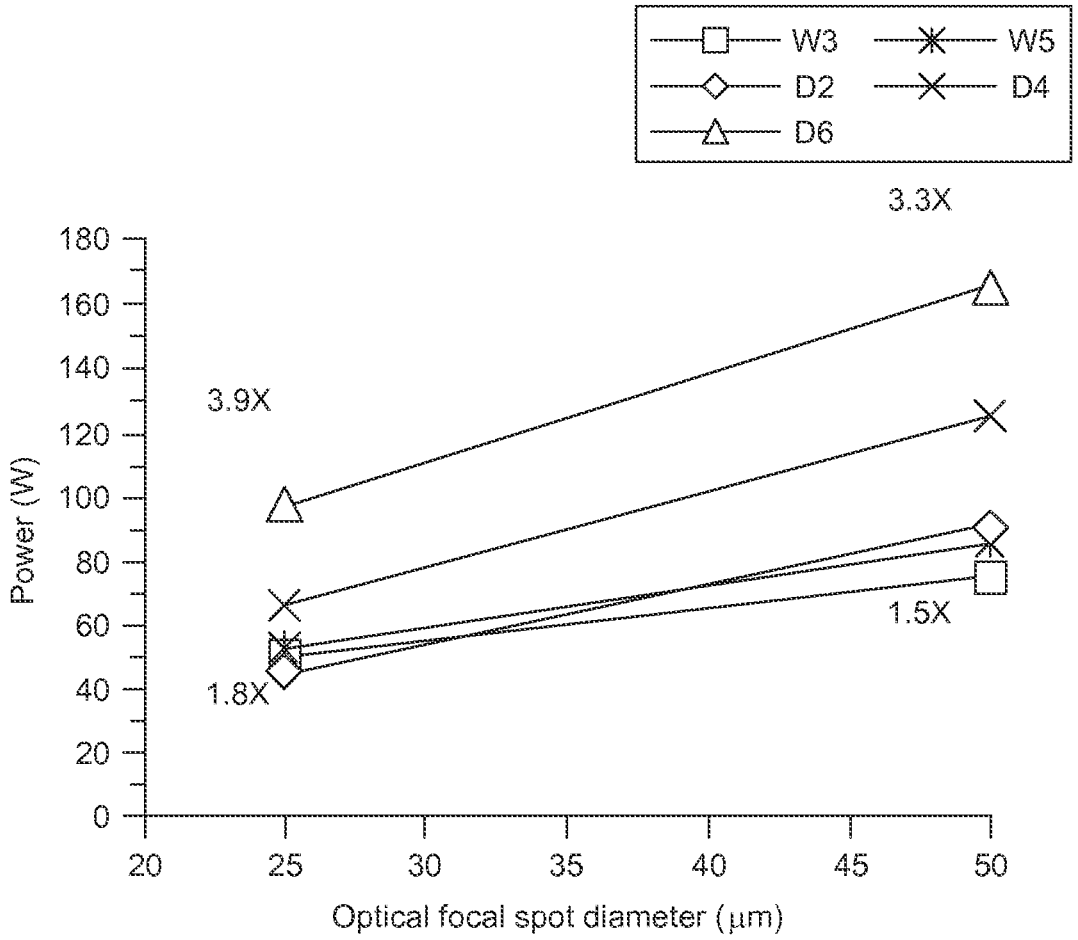
FIG. 11 graphically depicts power, temperature, and focal spot relationships for various embodiments of a multi-layer source target, in accordance with aspects of the present disclosure.

The results of Table 3 are also charted on FIG. 11, showing expected results for the different multi-layer configurations at the 25 μm and 50 μm optical focal spot diameters (x-axis) for the associated target powers (y-axis). As will be appreciated, in these examples, the high thermal conductivity benefit is comparably less for larger focal spot sizes due to the thermal limit of the thermally-conductive material employed (i.e., diamond). For other thermally-conductive materials, a higher thermal limit may be obtained and benefits may be seen at larger optical focal spot sizes.

This written description uses examples to disclose the invention, including the best mode, and also to enable any person skilled in the art to practice the invention, including making and using any devices or systems and performing any incorporated methods. The patentable scope of the invention is defined by the claims, and may include other examples and combinations that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An X-ray source, comprising:

an emitter configured to emit an electron beam; and a target having an emitter-facing surface and configured to generate X-rays when impacted by the electron beam, the target comprising:

two or more X-ray generating layers at different depths relative to the emitter-facing surface, each X-ray generating layer having a different thickness; and at least one intervening thermally-conductive layer between each pair of X-ray generating layers;

wherein the X-ray generating layers further from the emitter-facing surface are thicker than X-ray generating layers nearer the emitter-facing surface.

2. The X-ray source of claim 1, wherein the two or more X-ray generating layers comprise one or more regions of an X-ray generating material that produces X-rays when impacted by the electron beam.

3. The X-ray source of claim 1, wherein two or more of the X-ray generating layers comprise different X-ray generating materials.

4. The X-ray source of claim 1, comprising at least two intervening thermally-conductive layers differing in one or both of composition or thickness.

5. The X-ray source of claim 1, wherein the emitter-facing surface comprises a thermally-conductive material.

6. The X-ray source of claim 1, further comprising a thermally-conductive substrate opposite the emitter-facing surface.

7. The X-ray source of claim 1, wherein one or more X-ray generating layers comprise a tungsten region and the at least one thermally-conductive layer comprises diamond.

8. The X-ray source of claim 1, wherein one or more X-ray generating layers comprise an X-ray generating material region having a cross-sectional extent less than the cross-sectional extent of the respective X-ray generating layer.

9. A method for fabricating an X-ray source target, comprising:

forming a first X-ray generating layer, wherein the first X-ray generating layer has a first thickness;

on the first X-ray generating layer, forming one or more sets of:

an intervening thermally-conductive layer; and an additional X-ray generating layer, wherein each X-ray generating layer has a different thickness than other X-ray generating layers; wherein each additional X-ray generating layer formed over the first X-ray generating layer is less thick than those X-ray generating layers formed prior.

10. The method of claim 9, wherein the first X-ray generating layer is formed on a thermally-conductive substrate.

11. The method of claim 9, wherein forming the first X-ray generating layer comprises forming the first X-ray generating layer on a thermally-conductive substrate.

12. The method of claim 9, wherein the step of forming one or more sets of an intervening layer and an additional X-ray generating layer comprises forming more than one set of said layers, and wherein the thermally conductive layer of one set has a different thickness than the thermally conductive layer of another set.

13. The method of claim 12, wherein forming one or both of the first X-ray generating layer or the additional X-ray generating layers comprises forming a continuous X-ray generating material region across the full cross-sectional extent of the respective X-ray generating layer.

14. The method of claim 12, wherein forming one or both of the first X-ray generating layer or the additional X-ray generating layers comprises forming an X-ray generating material region across less than the full cross-sectional extent of the respective X-ray generating layer and forming one or more thermally-conductive regions across the remainder of the respective X-ray generating layer.

* * * * *